United States Patent [19]

Bremer

[11] 4,446,968

[45] May 8, 1984

[54] CARRY COVER ART OIL CANVAS

[76] Inventor: Mary E. Bremer, 11220 Willowbrook Dr., Potomac, Md. 20854

[21] Appl. No.: 419,342

[22] Filed: Sep. 17, 1982

[51] Int. Cl.[3] ..... B65D 6/00; B65D 23/10; B65D 85/00; D06F 3/08

[52] U.S. Cl. ..... 206/451; 16/110 R; 16/DIG. 24; 38/102.5; 38/102.7; 160/374.1; 160/380; 206/1.7; 294/137

[58] Field of Search ..... 206/1.7, 286, 451, 454; 38/102, 102.1, 102.2, 102.5, 102.7, 102.8; 160/373, 374, 374.1, 380; 223/74, 77, 89, 90, 94; 294/137, 138, 140; 269/214, 249; 16/DIG. 24, DIG. 25

[56] References Cited

U.S. PATENT DOCUMENTS

| | | | |
|---|---|---|---|
| Re. 6,179 | 12/1874 | Thompson | 160/374 |
| 142,735 | 9/1873 | Scherfe | 160/380 |
| 328,278 | 10/1885 | Bohlinger | 38/102.7 |
| 682,493 | 9/1901 | Pendleton | 294/138 |
| 1,032,839 | 7/1912 | Kemler | 160/380 |
| 1,200,052 | 10/1916 | Trover | 38/102.1 |
| 2,038,890 | 4/1936 | Crampton | 206/1.7 |
| 2,378,665 | 6/1945 | Threeton | 206/286 |
| 2,645,141 | 7/1953 | Anthony | 269/214 |
| 3,529,653 | 9/1970 | Fey, Jr. | 160/374.1 |
| 3,882,616 | 5/1975 | Starzyk | 160/374.1 |
| 4,229,890 | 10/1980 | Dropinski | 38/102.1 |

FOREIGN PATENT DOCUMENTS

| | | | |
|---|---|---|---|
| 681772 | 9/1939 | Fed. Rep. of Germany | 38/102.8 |
| 23325 | of 1895 | United Kingdom | 160/374.1 |

*Primary Examiner*—George E. Lowrance
*Assistant Examiner*—Jimmy G. Foster
*Attorney, Agent, or Firm*—Henderson & Sturm

[57] ABSTRACT

This invention relates to carrying cases for fragile items in general, and more specifically to a unique carry case having cooperating panels that can be adjusted relative to one another to support various sized artist oil canvas.

5 Claims, 5 Drawing Figures

CARRY COVER ART OIL CANVAS

BACKGROUND OF THE INVENTION

While the prior art is replete with artists canvas carriers and the like, as can be seen by reference to U.S. Pat. Nos. 2,950,001; 3,165,498; 4,061,259 and 408,937, these devices have not met with widespread commercial success and acceptance for a variety of reasons.

One of the more prevalent complaints surrounding this type of a device has been the inherent inability of the carriers to accommodate canvases having various sizes.

Up until the present time it was also virtually impossible to find a canvas carrier that would be a lightweight, sturdy, easily assembled and disassembled, and which would collapse when not in use to a very compact size for storage.

As a result of deficiences of the prior art devices, the present invention was developed. The end result of this development produced a unique cooperation of a plurality of panels, comprising two separate cover members, which are clamped together to form an adjustable size carry cover for art oil canvases.

SUMMARY OF THE INVENTION

An object of the present invention is to provide a lightweight, sturdy, protective cover and carrying case for artists canvas.

Another object of the present invention is to provide a canvas carrier that can be adjusted to accommodate artists canvas having various sizes.

Still another object of the present invention is to provide a canvas carrier that can be collapsed into a very compact size for storage purposes.

Yet another object of the present invention is to provide an adjustable canvas carrier that addresses and solves all of the problems associated with the prior art devices.

A further object of the present invention is the development of a simple, efficient, sliding, and selectively lockable cooperation between a plurality of panels to form the two cover members that comprise an adjustable canvas carrier.

A yet further object of the present invention is to provide a combined clamp and carrying handle for joining together the two cover members that comprise the aforementioned canvas carrier.

These and other objects, advantages, and novel features of the invention will become apparent from the detailed description that follows, when considered in conjunction with the accompanying drawings.

DETAIL DESCRIPTION OF THE PREFERRED EMBODIMENT

Figure 1:
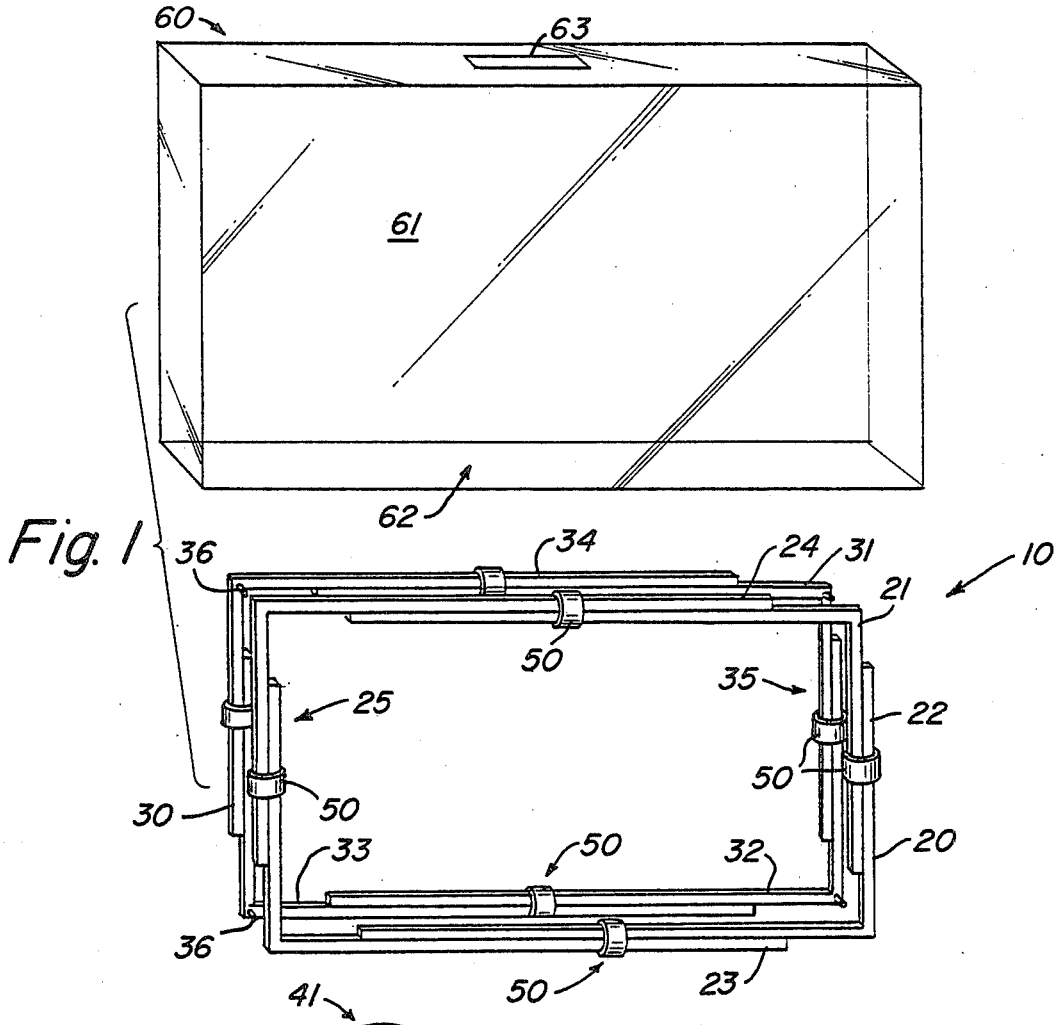
FIG. 1, is an exploded perspective view of the carry cover and its associated protective cover.
Figure 2:
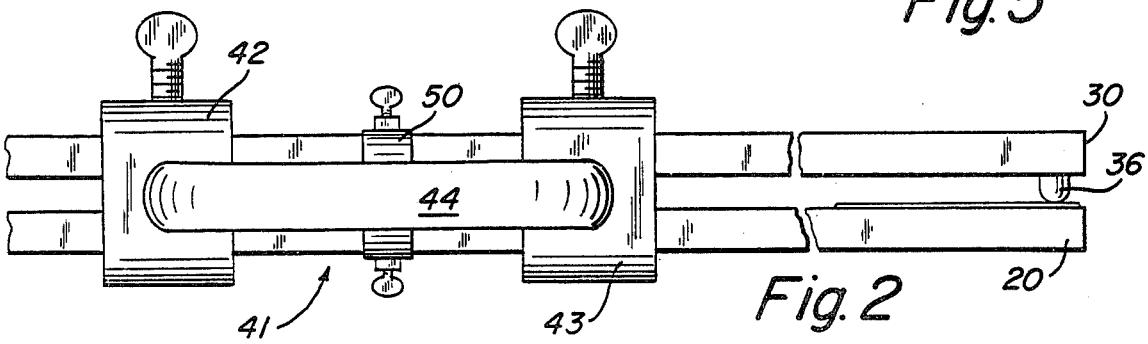
FIG. 2, is a detail view of the cover members and their associated carrying handle.

As can be seen by reference to FIGS. 1 and 2, the artist's canvas carry cover is designated generally as 10, and comprises two separate adjustable members 20 and 30, that are joined together by securing means 40. The cover member 20, comprises four L-shaped frame members 21,22,23 and 24. Each leg of the L-shaped frame members is provided with means 50, which are adapted to slidingly engage the legs of adjacent frame members, to form an expandable rectangular framework 25.

The cover member 30, also comprises four L-shaped frame members 31,32,33 and 34, having the same dimensions and configuration as the frame members 21 thru 24, with the exception that an inwardly facing small projection in the form of a peg 36, is disposed on the frame members 31 thru 34, proximate the juncture of the two legs that form the L-shaped configuration. In the preferred embodiment, these pegs are approximately one-half inch (½") in length, and are intended to brace the canvas 1, between the cover members 20 and 30, when they are clamped together. As was the case with cover member 20, each leg of the L-shaped frame members 31,32,33 and 34, is provided with means 50, which are adapted to slidingly engage the legs of adjacent frame members, to form an expandable rectangular framework 35.

Each of the L-shaped frame members in the preferred embodiment comprise a 12" leg and a 16" leg. In instances where the legs are fabricated from hard plastic, the legs may be formed integrally; when the chosen material is metal, they may be joined by adhesives or welding; and in instances where the material is wood, either nails or adhesives will suffice.

The means for slidingly engaging the frame members together in one form of the preferred embodiment comprise generally circular clamp members 50, that surround each pair of cooperating legs on the respective frame members, to assemble the frame members into the rectangular frameworks 25 and 35. The clamp members 50, are designed to be actuated to frictionally engage the cooperating frame members in a desired position, and yet be releasable to allow the frame members to slide relative to one another.

In another form of the preferred embodiment (not shown) the exterior surface of the frame members are provided with a dovetail projection running along their exterior length, and the interior surfaces are provided with a complimentary dovetail recess running along their interior length. This construction is particularly well suited for those instances where plastic or wood is used in the fabrication of the frame members. In addition, the sliding engagement between the complimentary dovetail portions allows a single set screw to be disposed on each of the four sides of the rectangular frameworks 25 and 35, to releasably lock the frame members together. An added benefit of this particular construction is that the interior and exterior faces of the cover member 20 and 30, will always be aligned in the vertical plane.

In either of the aforementioned instances the cover members 20 and 30, can be expanded from an approximately 12"×16" rectangular framework, to secure canvases having dimensions that fall within that range therebetween.

Figure 3:
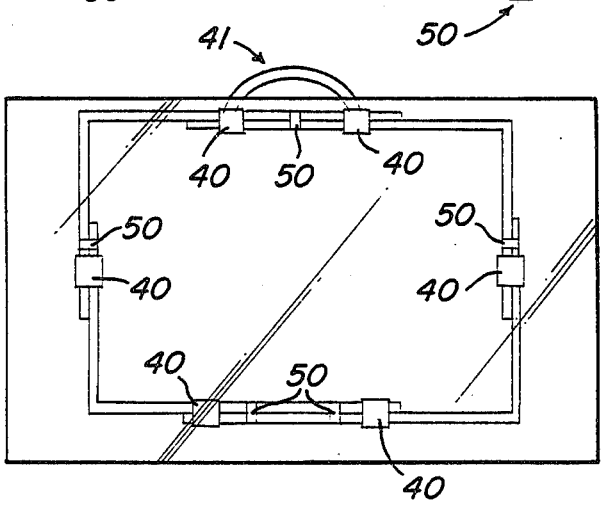
FIG. 3, is a side view of the cover members in their assembled relationship.
Figure 4:
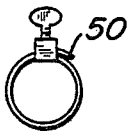
FIG. 4, is a detail view of one type of clamp used to join a single cover member together.
Figure 5:
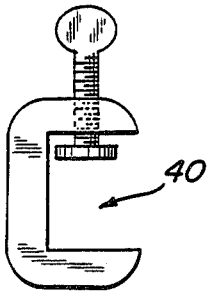
FIG. 5, is a detail view of a one type of clamp used to join one cover member to the other.

As can best be seen by references to FIG. 3, a plurality of C-shaped cover clamps 40, are provided, in order to secure a canvas between the cover members 20 and 30. In the preferred embodiment, a plurality of cover clamps 40, are provided to secure the bottom portions of the rectangular frameworks 25 and 35 together, and single cover clamps are provided along each side of the cover members.

The top portion of the cover members 20 and 30, on the other hand are provided with a combined clamp and carrying handle device 41, which comprises a pair of C-shaped clamps 42, and 43 which are connected together by an elongated handle member 44. When this device 41, is attached to the cover member 20 and 30, it performs the dual functions of clamping the top portions of the cover member together at two separate locations, and also providing a carrying handle, whereby the canvas can be easily transported while still wet.

The final element that comprises the artist canvas carry cover 10, is a protective cover 60, for the cover member 20 and 30. This protective cover 60, comprises a flexible rectangular enclosure 61, whose length and height will be slightly longer than the length and height of the rectangular frameworks 25 and 35, in their fully expanded mode (i.e., 24"×32"), and whose width will be slightly longer than (e. g+1") the combined width of the two cover members 20 and 30, and the canvas 1.

As can be seen by reference to the drawings, the protective cover 60, is provided with an open bottom 62, and an apertured top 63. The aperture 63, in the top of the protective cover is dimensioned to allow the handle 44 to project therethrough so that the handle can be grasped after the protective cover 60, has been slipped over the cover members 20 and 30.

The operation of the artist canvas carry cover is as follows: When it is desired to transport a wet canvas, the cover members 20 and 30, are expanded so the the dimensions of the frameworks 25 and 35, are equal to, or slightly larger than the dimensions of the canvas 1. Cover member 20, is aligned with and places against the dry side of the canvas, and cover member 30, is aligned with and placed against the wet side of the canvas. When the cover members are so aligned only the ends of the pegs 36, will be contacting the corners of the wet side of the canvas. The C-shaped cover clamps 40, are then attached to the bottom and sides, to secure the cover members together, and the combined clamp and handle 41, is attached to the top of the cover members to complete the securing of the canvas therebetween. The protective cover 60, is then slipped over the cover members 20 and 30, and the canvas can now be transported safely and securely, without having to worry about the exposure of the wet canvas to smudges, dirt, rain, etc.

When the device 10, is not being used, the protective cover 60, may be folded up, and the cover members can be collapsed down to their smallest dimension so that the various components will take up as little storage space as possible.

Having thereby disclosed the subject matter of this invention, it should be obvious that many substitutions, modifications and variations of the invention are possible in light of the teachings contained herein. It is therefore to be understood that the invention as taught and described above, is only to be limited to the extent of the breadth and scope of the appended claims.

What I claim is:

1. An artists canvas carry cover for transporting a wet oil canvas comprising:

a first and second adjustable cover member in the form of an expandable rectangular framework, wherein each of said rectangular frameworks comprise four L-shaped members, and each leg of each L-shaped member is provided with means that will slidingly engage at least one leg of other L-shaped members to form the individual expandable rectangular frameworks, and wherein only one of said first and second adjustable cover members is provided on each of the four corners of the expandable rectangular framework with a single inwardly facing projection in the form of a small peg, that is adapted to frictionally engage the corners of the wet canvas, when the canvas is interposed between the first and second cover members, and securing means for joining the said members together on either side of an artists canvas, wherein the securing means includes a combined clamp and handle device comprising a pair of generally C-shaped clamps connected by an elongated handle member, wherein each of said C-shaped clamps is dimensioned to engage at least one leg on the top each of said rectangular frameworks.

2. A carry cover as in claim 1; wherein, the means which are adapted to slidingly engage the legs of adjacent frame members to form the expandable rectangular framework comprise:

generally circular clamp member that surround each pair of cooperating legs on the respective frame members, to assemble the frame members into the expandable rectangular framework.

3. A carry cover as in claim 1; wherein, the securing means further comprise:

a plurality of generally C-shaped clamps disposed around the sides and bottom of the said cover members.

4. A carry cover as in claim 3; further comprising, a protective cover dimensioned to fit over said cover members in their fully expanded and assembled relationship.

5. A carry cover as in claim 4; wherein, said protective cover comprises:

a flexible rectangular enclosure having an open bottom and an apertured top, wherein the aperture is dimensioned to receive the said elongated handle member.

* * * * *